US005605106A

United States Patent [19]

Ackermann et al.

[11] Patent Number: 5,605,106

[45] Date of Patent: Feb. 25, 1997

[54] FRONT ROLLER FEEDER

[75] Inventors: Manfred Ackermann, Elmhurst; Dale R. Carr, Belvidere; Larry D. Crisler, Crystal Lake, all of Ill.

[73] Assignee: Union Special Corporation, Huntley, Ill.

[21] Appl. No.: 493,849

[22] Filed: Jun. 20, 1995

[51] Int. Cl.[6] ..... D85B 27/12

[52] U.S. Cl. ..... 112/475.01; 112/153; 112/322; 112/147; 112/DIG. 3; 112/235

[58] Field of Search ..... 112/153, 306, 112/318, 322, 320, 147, 141, DIG. 3, 235, 475.01

[56] References Cited

U.S. PATENT DOCUMENTS

| | | | |
|---|---|---|---|
| 1,715,119 | 5/1929 | Clarkson | 112/322 X |
| 1,723,786 | 8/1929 | Jones | 112/322 |
| 1,988,372 | 1/1935 | Christensen et al. . | |
| 1,990,616 | 2/1935 | Rubel . | |
| 2,035,365 | 3/1935 | Clayton . | |
| 2,494,888 | 1/1950 | Vesconte et al. . | |
| 2,678,010 | 5/1954 | Pinkvoss . | |
| 2,692,568 | 10/1954 | Galkin . | |
| 2,730,977 | 1/1956 | Hayes et al. . | |
| 2,907,291 | 10/1959 | Schrader | 112/318 |
| 3,003,443 | 10/1961 | Condran . | |
| 3,425,377 | 2/1969 | Scharmer, Jr. | 112/322 X |
| 3,726,240 | 4/1973 | Emich . | |
| 3,853,078 | 12/1974 | Marforio . | |
| 3,994,248 | 11/1976 | Marforio . | |
| 4,073,248 | 2/1978 | Marforio . | |
| 4,152,995 | 5/1979 | Klundt . | |
| 4,187,795 | 2/1980 | Norton | 112/318 |
| 4,217,842 | 8/1980 | Luigi . | |
| 4,290,376 | 9/1981 | Brucasca et al. | 112/322 X |
| 4,462,530 | 7/1984 | Block et al. . | |
| 4,572,094 | 2/1986 | Taddicken . | |
| 4,854,254 | 8/1989 | Hsing . | |
| 5,090,344 | 2/1992 | Wang | 112/153 X |
| 5,331,910 | 7/1994 | Mukai et al. | 112/322 X |

FOREIGN PATENT DOCUMENTS

| | | |
|---|---|---|
| 312545 | 8/1928 | United Kingdom . |
| 837654 | 6/1960 | United Kingdom . |
| 2204333 | 11/1988 | United Kingdom . |
| 2219604 | 12/1989 | United Kingdom . |

*Primary Examiner*—Paul C. Lewis
*Attorney, Agent, or Firm*—Brinks Hofer Gilson & Lione

[57] ABSTRACT

A fabric feed mechanism that includes a forward feed roller located forward of the stitch forming area and a rear feed roller located to the rear of the stitch forming area. The drive to the forward and rear feed rollers is synchronized such that the fabric is fed to the stitch forming instruments in a relaxed and unstretched condition. There is a independently applied downward pressure to forward and rear feed rollers and the forward feed roller is raised along with the presser foot. The front feed roller has sections that are located on opposite sides of the presser foot toe to thus ensure that the top layer of fabric is fed under the presser foot rather than riding up the front roller.

30 Claims, 10 Drawing Sheets

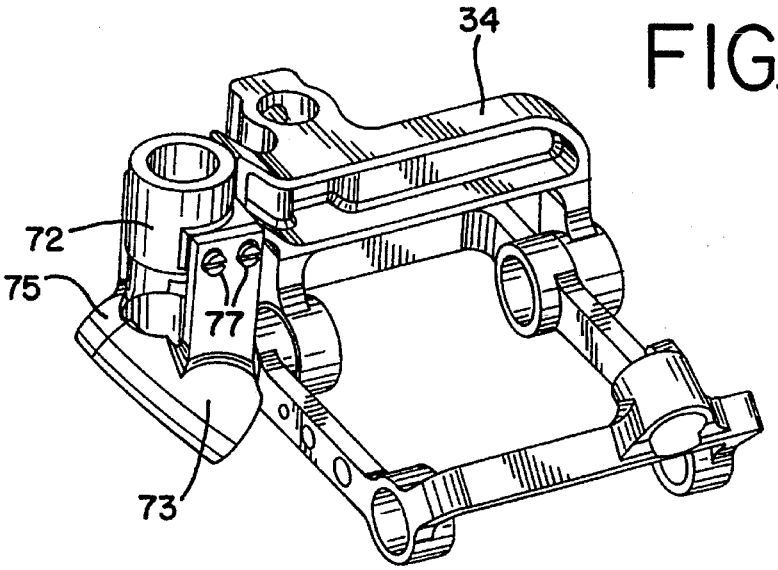
FIG. 10
FIG. 9
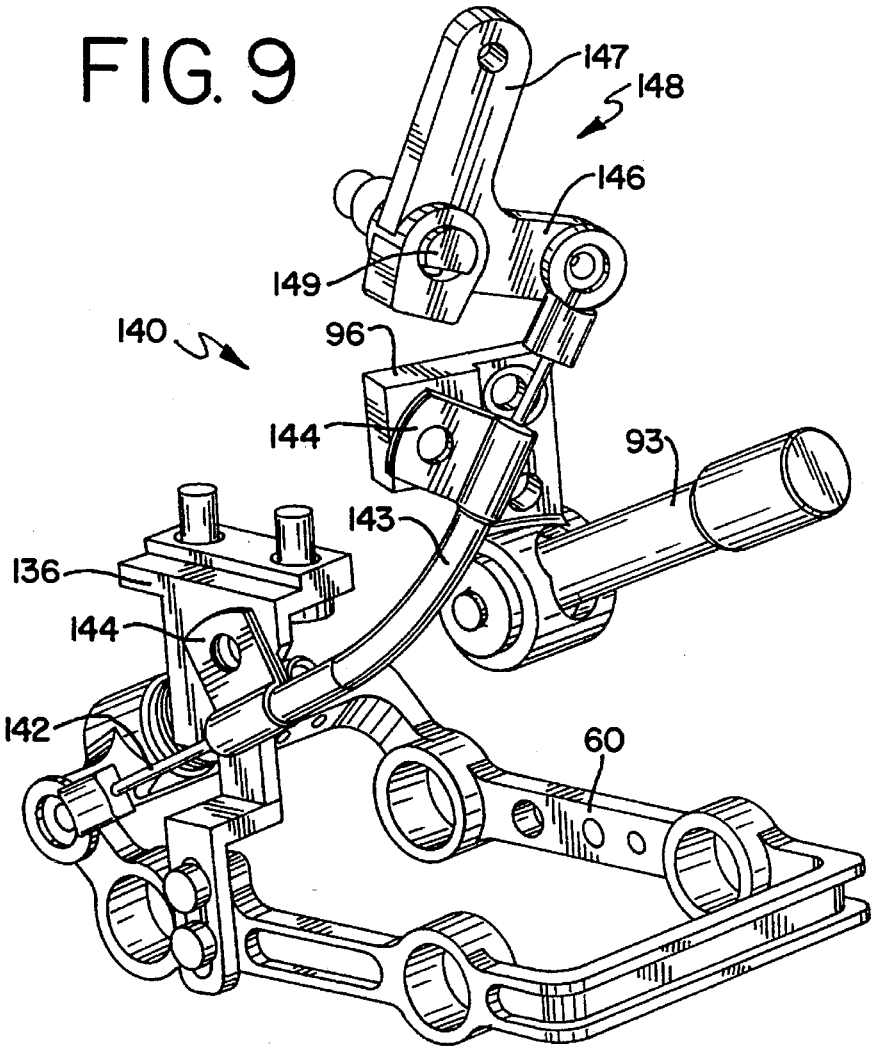

FIG. 15
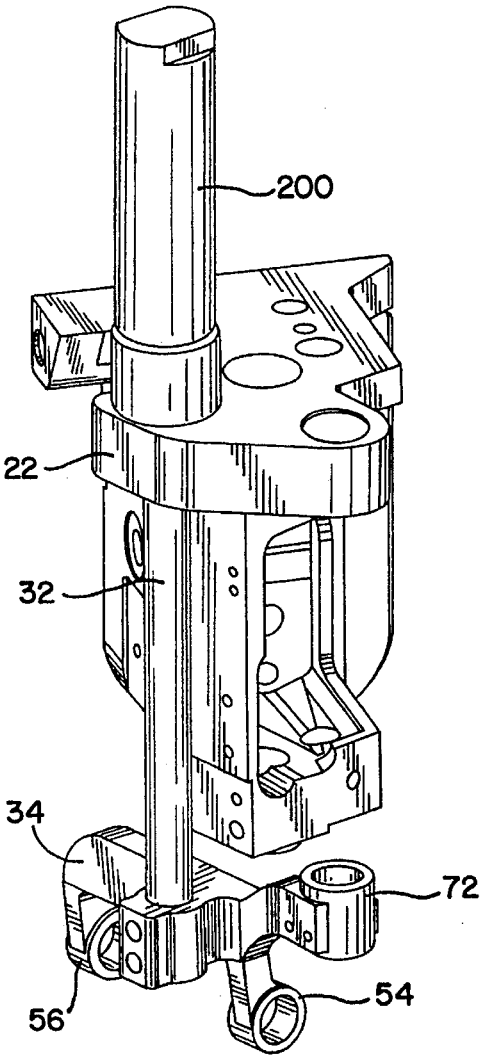
FIG. 16
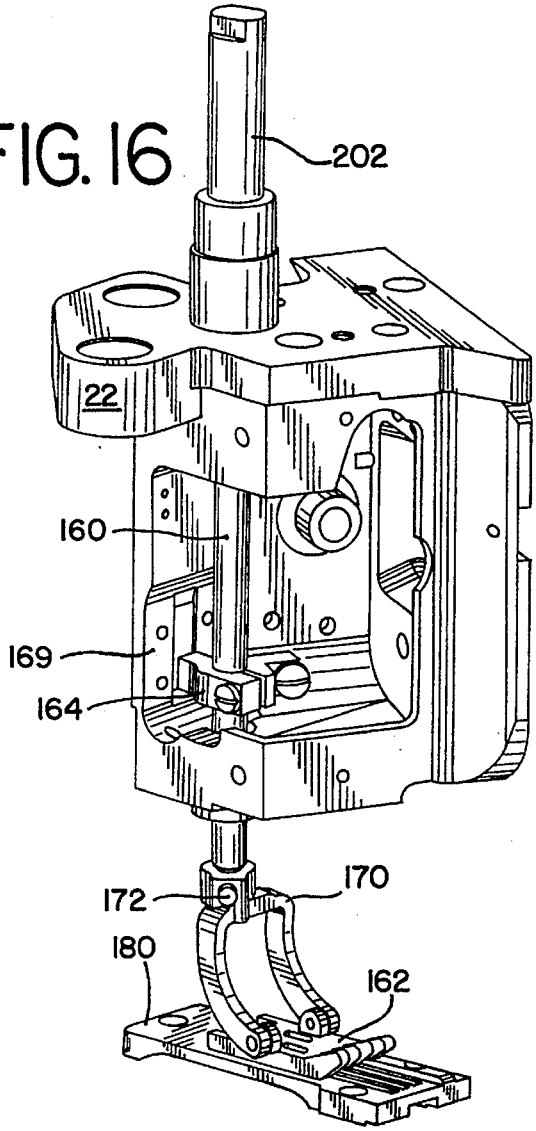
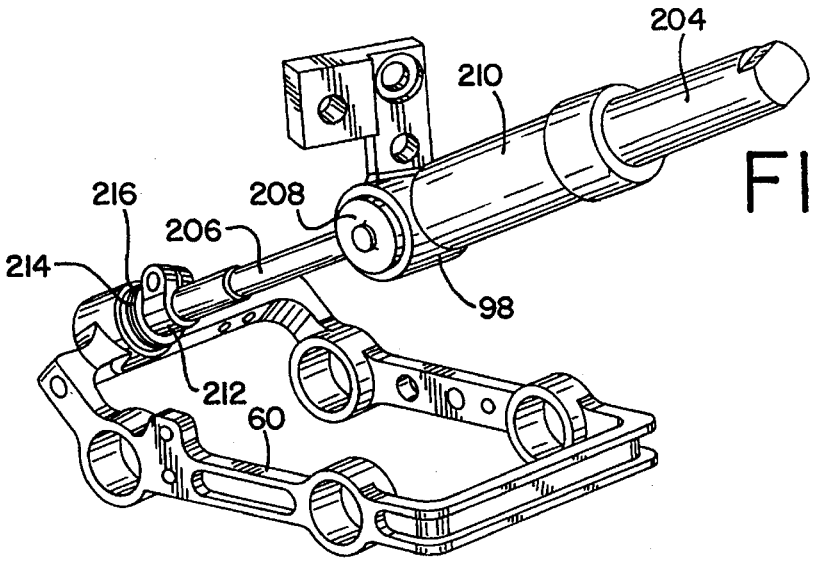
FIG. 17

FRONT ROLLER FEEDER

BACKGROUND OF THE INVENTION

The Union Special Corporation Model 35800 High Speed Feed Off-The-Arm machine is used to produce felled seams on medium to heavy weight denim. This machine, is used to produce either double felled or single fell seams. The Model 35800 High Speed Feed Off-The-Arm machine has three needles and three loopers and produces three rows of Type 401 stitches. In addition to the conventional feed dogs and presser foot, this machine includes a driven upper feed roller that engages the upper surface of the fabric behind the stitch forming area and functions to pull the fabric in the direction of feed.

When using this machine to produce a double felled seam along the inseam of denim jeans or for piecing sleeves on denim jackets, a feller assembly is located forward of the stitch forming area to assist the operator in interlapping the marginal edges of the upper and lower plies of fabric.

Denim is made from large yarns and is a "twill" type fabric that easily stretches. This characteristic of denim is the reason that jeans are so comfortable to wear. However, this characteristic of denim also makes denim difficult to sew. When sewing denim fabric the fabric should be in its natural relaxed state rather than in a stretched state. If denim is sewn when it is stretched, the seam will become distorted when the fabric attempts to return to its relaxed state.

When producing inseams on denim jeans, the operator must use her or his fingers to manually push the interlaped fabric into the stitch forming area of the sewing machine. This is necessary to assure that the fabric is being stitched in its natural relaxed state and also to assure even margins along the felled seam. The production of acceptable inseams on denim jeans requires a highly skilled operator who is experienced and who has been extensively trained. When producing the inseam on denim jeans when the cross seam is encountered, the number of fabric plies abruptly quadruples. A double felled seam has four plies of material, however, when four double felled seams converge at a point, as occurs at the crouch of a pair of denim jeans, sixteen plies of material must be sewn together. Pushing the fabric into the stitch forming area when cross seams are encountered is particularly stressful on the fingers and hands of the sewing machine operator. Furthermore, if the operator must concentrate her or his attention and efforts on pushing the fabric into the stitch forming area, their attention to other facets of the operation is diminished and it becomes more likely that the fabric will not be properly fed into the feller attachment. For the foregoing reasons, there is a need for a machine that can relieve the sewing machine operator of the manual and stressful task of pushing the folded fabric into the stitching area of the sewing machine.

SUMMARY OF THE INVENTION

The present invention is directed to an apparatus that satisfies the need for an apparatus that will feed the fabric that has been folded to form a felled seam to the stitch forming mechanism in its natural relaxed state and to assure that the margins along the seam will be even and uniform. The apparatus consists of a sewing machine including a sewing head and a work support portion in combination with a puller feed roller disposed to the rear of the stitch forming mechanism and a synchronized driven feed roller disposed forward of the stitch forming mechanism.

The invention also consists of an upper front feed mechanism that is operatively associated with the presser foot for a sewing machine of the type that includes a lower feed mechanism that is operatively associated with the presser foot that will cooperate to feed the fabric to the stitch forming mechanism in a relaxed unstretched condition.

Another aspect of this invention consist of an apparatus including a sewing head and a work support portion in combination with a puller feed roller disposed to the rear of the stitch forming mechanism that is biased downwardly and a driven feed roller disposed forward of the stitch forming mechanism that is biased downwardly independently of the rear puller feed roller.

Still another aspect of this invention consists of a cooperative relationship between a front roller feeder and the presser foot of the sewing machine that will prevent the work product from riding up from the work surface with the front roller feeder.

Yet another aspect of this invention consists of a front roller feeder that will be raised up from the work surface along with the presser foot.

BRIEF DESCRIPTION OF THE DRAWINGS

FIG. 9 is a rear perspective view of a portion of the mechanism of this invention in which the manual lift cable assembly is clearly visible.

FIG. 10 is a front perspective view of a portion of the mechanism of this invention in which the miter gear case for the rear roller drive is clearly visible.

FIG. 15 is a rear perspective view of a portion of the mechanism of this invention in which the air lift mechanism for the main bracket is shown.

FIG. 16 is a front perspective view of a portion of the mechanism of this invention in which the presser foot bar, presser foot holder, presser foot, throat plate and the presser bar air lift mechanism are clearly visible.

FIG. 17 is a rear perspective view of a portion of the mechanism of this invention in which the front air pressure lift mechanism is clearly visible.

DETAILED DESCRIPTION OF THE PREFERRED EMBODIMENT

Figures 1, 1A:
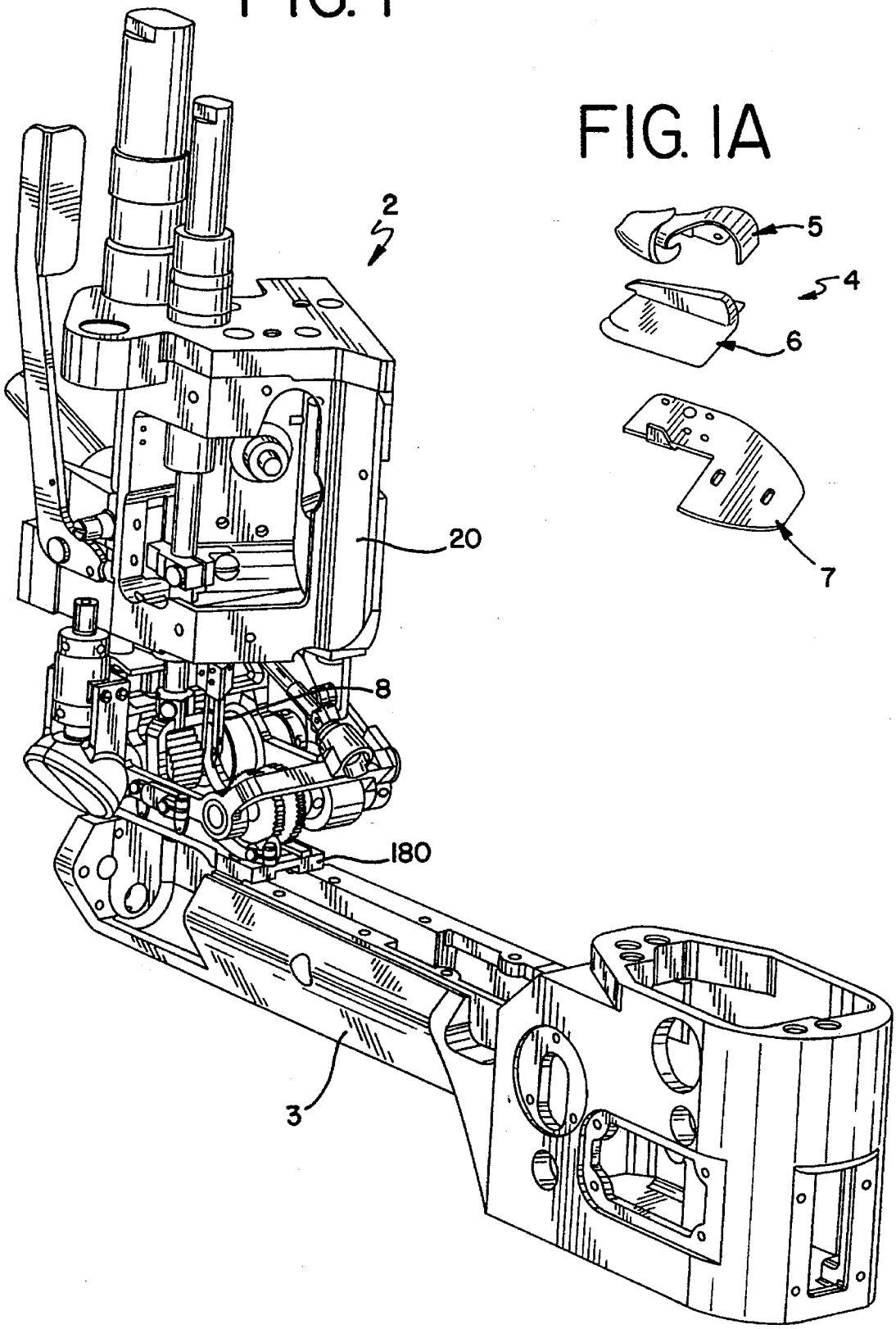
FIG. 1 is a perspective view of the upper head portion of a High Speed Feed Off-The-Arm sewing machine having an embodiment of this invention mounted thereon.
FIG. 1A is an exploded view of a feller assembly of the type that could be used with the sewing machine illustrated in FIG. 1.

FIG. 1 is a perspective view of the upper head portion 20 of a High Speed Feed Off-The-Arm sewing machine 2 including a lower arm 3 and reciprocating needles 8 that cooperate with loopers to form rows of 401 type stitches. An embodiment of the front roller feeder 30 of this invention is included in FIG. 1 to illustrate how it is mounted on the sewing machine 2.

FIG. 1A is an exploded view of a feller assembly 4 for a double felled seam of the type that could be used with the sewing machine 2 illustrated in FIG. 1. The feller assembly 4 includes an upper scroll 5, a lower scroll 6 and a base or work supporting surface 7. The assembled feller assembly 4 is mounted on the lower arm 3 of the sewing machine 2 forward of the throat plate 180.

Figure 2:
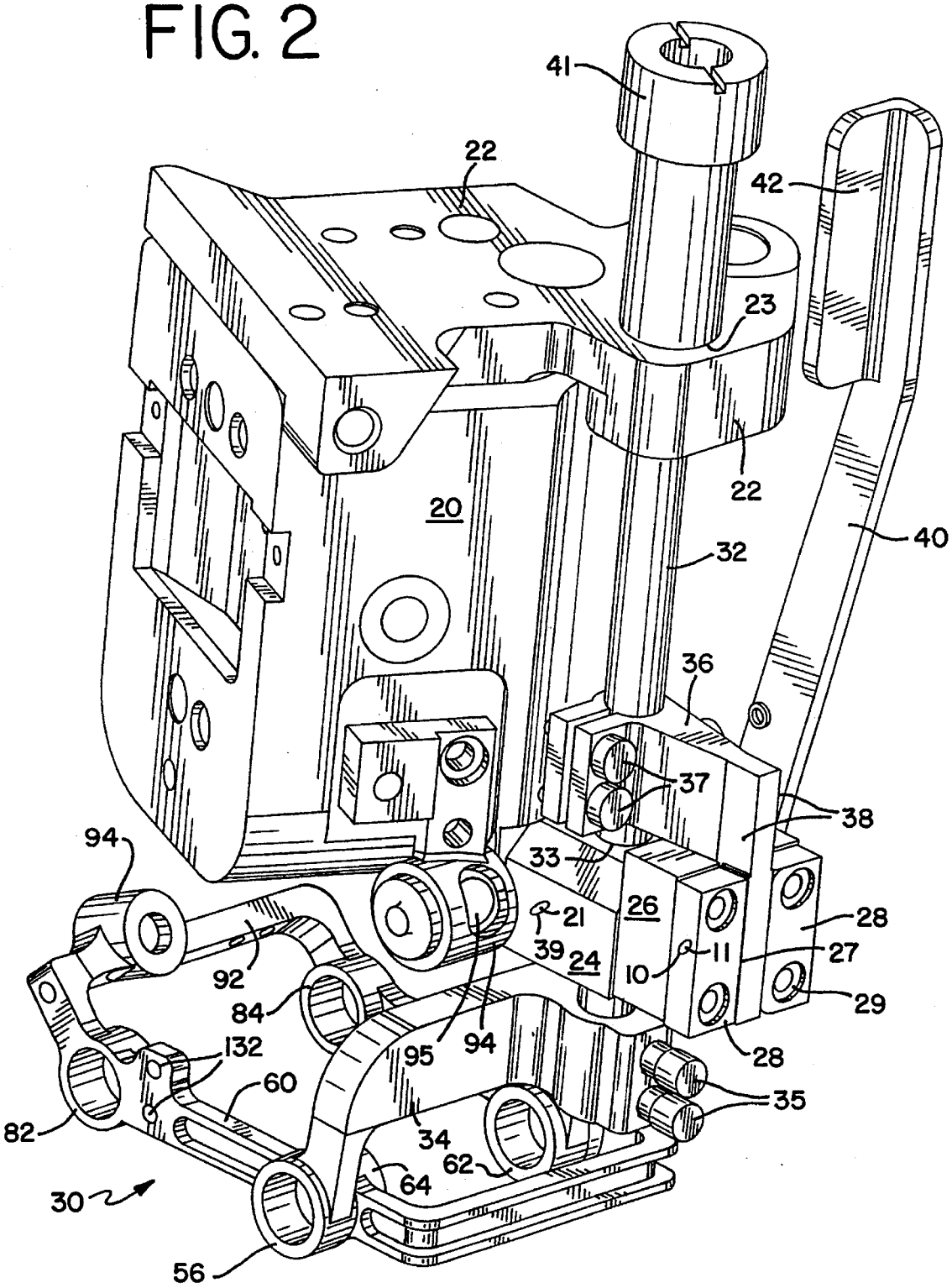
FIG. 2 is a rear perspective view of a portion of the mechanism of this invention in which the rear guidance system and rear spring pressure system mechanisms are clearly visible.

FIG. 2 is a rear perspective view of the upper head 20 and top plate 22 of the Feed Off-The-Arm sewing machine 2. An aperture 23 in the top plate 22 slidingly receives the rear shaft 32 that functions to raise and lower the main bracket 34 of the front roller feeder 30. The bottom end of rear shaft 32 is connected to the main bracket 34 by set screws 35. A rear guide finger 36, having a pair of machined guide surfaces 38 formed thereon, is secured to the rear shaft 32 by set screws 37.

A rear guide block 24 is secured to the lower portion of the upper head 20. The bolt holes 25 for connecting the rear guide block 24 to the lower portion of the upper head 20 are visible in FIG. 15. A vertical bore 33 is formed in the rear guide block 24 that slidably receives the rear shaft 32. A horizontal bore 39 is formed in the rear guide block 24 that intersects with the vertical bore 33. An oil wick 21 is provided in the horizontal bore 39 that functions to lubricate the sliding surfaces of the rear shaft 32 and the vertical bore 33. A pair of support blocks 26 are secured to the rear guide block 24 and a rear guide thrust block 28 is secured to each support block 26 by screws 29.

The rear guide thrust blocks 28 have machined edges 27 that engage the machined guide surfaces 38 of the rear guide finger 36 to thus provide precision guidance for the front roller feeder 30 as it is raised and lowered with the rear shaft 32. The rear guide thrust blocks 28 can be adjusted on the support blocks 26 through the screws 29. Horizontal bores 10 are formed in the rear guide thrust blocks that communicate with the machined edges 27. An oil wick 11 is provided in each of the bores 10 to provide lubrication to the sliding machined edges 27 and guide surfaces 38. If the rear guide thrust blocks 28 become worn it is a simple and inexpensive task to replace them.

Figure 3:
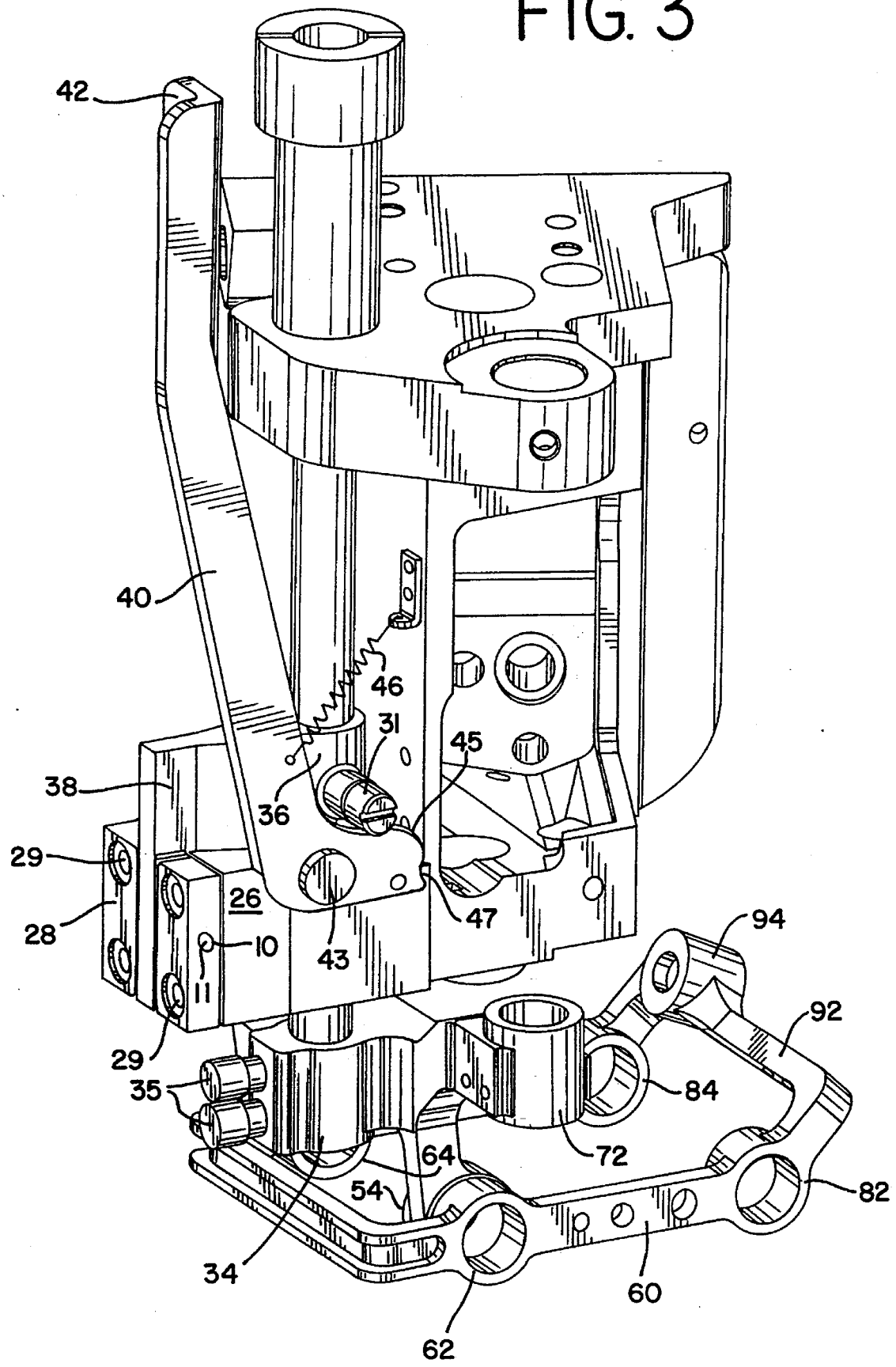
FIG. 3 is a side perspective view of a portion of the mechanism of this invention in which the manual lift for the rear shaft and the main bracket are clearly visible.
Figure 4:
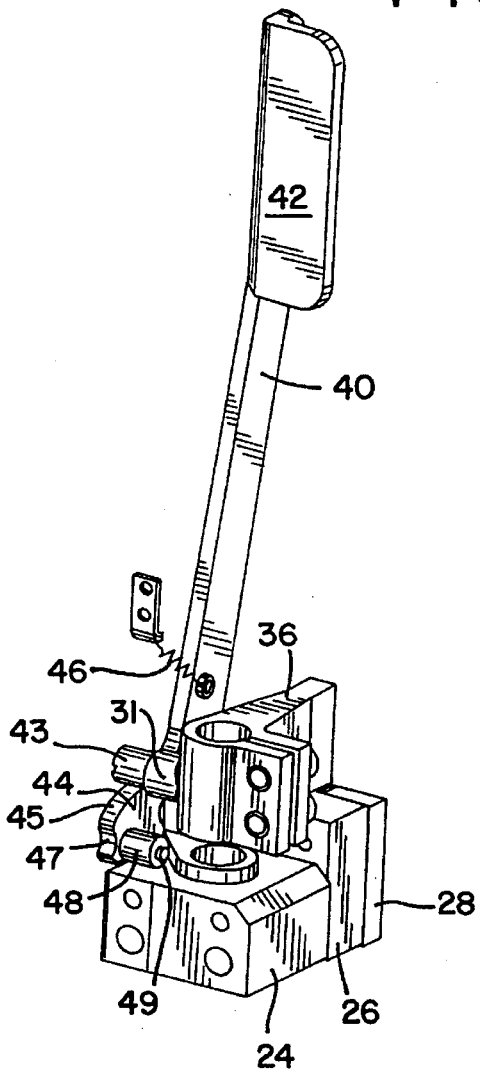
FIG. 4 is an isolated perspective view of the rear lift handle for the rear shaft and the main bracket.

Referring now to FIGS. 3 and 4, a manual lift handle 40 is pivotally mounted on the rear guide block 24 by a screw 43. The lift handle 40 has a gripping portion 42 at one end and a lever 44 at the other end. The rear guide finger 36 has a lift pin 31 protruding from it that is located to be engaged by a cam surface 45 formed on the upper edge of the rear lever 44. The cam surface has a depression 47 at the end portion of the lever 44 that is shaped to receive and contain the lift pin 31 to thus support the front roller feeder 30 in the full up position. The lift handle 40 is biased by spring 46 that causes the handle 40 to pivot about screw 43 in the clockwise direction as seen in FIG. 3. As best seen in FIG. 4, the lever 44 of the lift handle 40 has a stop pin 49 that carries a bumper 48. The clockwise rotation of the lift handle 40 is stopped when the bumper 48 engages the upper surface of the rear guide block 24.

During the sewing operation the main bracket 34 raises and falls slightly in response to the thickness of the fabric that the rear roller 50 is encountering. Thus, there is continuous movement between the engaging surfaces 27, 38 and 32, 33 during the sewing operation. These surfaces are lubricated by the oil wicks 11 and 21 to facilitate this movement and minimize wear on the parts.

When it is desired to lift the main bracket 34 off the work piece, the operator grasps the manual lift handle 40 by the gripping portion 42 and pivots it counterclockwise against the action of spring 46. When the lift pin 31 enters the depression 47 in the lever 44 the operator can release the lift handle and the main bracket 34 will be retained in the raised position.

The rear roller 50 is secured to a rear roller shaft 52 that is journaled for rotation in the hubs 54 and 56 of the main bracket 34 (see FIG. 15). A set of needle bearings is provided in hubs 54 and 56 to minimize frictional resistance to the rotation of roller shaft 52.

Figure 6:
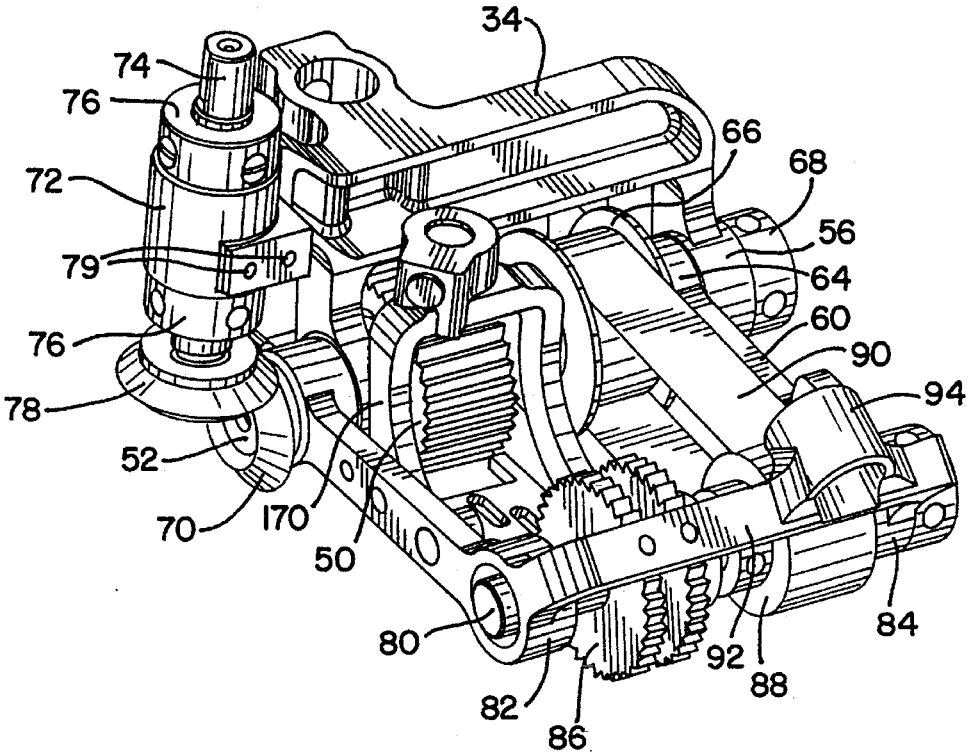
FIG. 6 is a top-front perspective view of a portion of the mechanism of this invention in which the front and rear rollers are clearly visible.

A front roller bracket 60, having a generally rectangular shape, includes hubs 62 and 64 that are journaled on the rear roller shaft 52. Hubs 62 and 64 are integral with the front roller bracket 60. A rear pulley 66, see FIG. 6, is secured to rear roller shaft 52 between the rear roller 50 and the hub 64. A thrust collar 68 is secured to one end of the roller shaft 52 and a driven miter gear 70 to its other end.

A vertically orientated hub 72 is carried by the main bracket 34 for journaling a drive shaft 74. A set of needle bearings is carried by the hub 72 for minimizing the friction in this journal. Thrust collars 76 are provided to maintain the drive shaft 74 in the hub 72. A drive miter gear 78 is carried by the lower end of drive shaft 74. Drive miter gear 78 meshes with the driven miter gear 70 and transmits rotary motion to roller shaft 52.

As seen in FIG. 10, a front cover 73 and a rear cover 75 are provided for the miter gears 70 and 78. The covers 73 and 75 are secured to the main bracket 34 by screws 77 that are threaded into threaded bores 79 in the main bracket 34. The preferred embodiment includes a one piece plastic cover for the miter gears 70 and 78.

The front roller bracket 60 (see FIG. 6 and 6A) includes a pair of hubs 82 and 84 at its forward end in which is journaled a front roller shaft 80. The hubs 82 and 84 have sets of needle bearings to minimize friction in these journals. A front roller 86 and a front pulley 88 are secured to front roller shaft 80 for rotation therewith. The front pulley 88 is aligned with rear pulley 66 and a drive belt 90 extends over the aligned pulleys 88 and 66 such that the rotary motion of rear roller shaft 52 is transferred to the front roller shaft 80. In the preferred embodiment the pulleys 66, 88 and the belt 90 are of the sprocket type that have grooves and ridges on their engaging surfaces. This sprocket type drive not only provides a more positive drive connection between the pulleys and the belt, but also ensures that the front roller 86 and rear roller 50 are synchronized.

Figure 8:
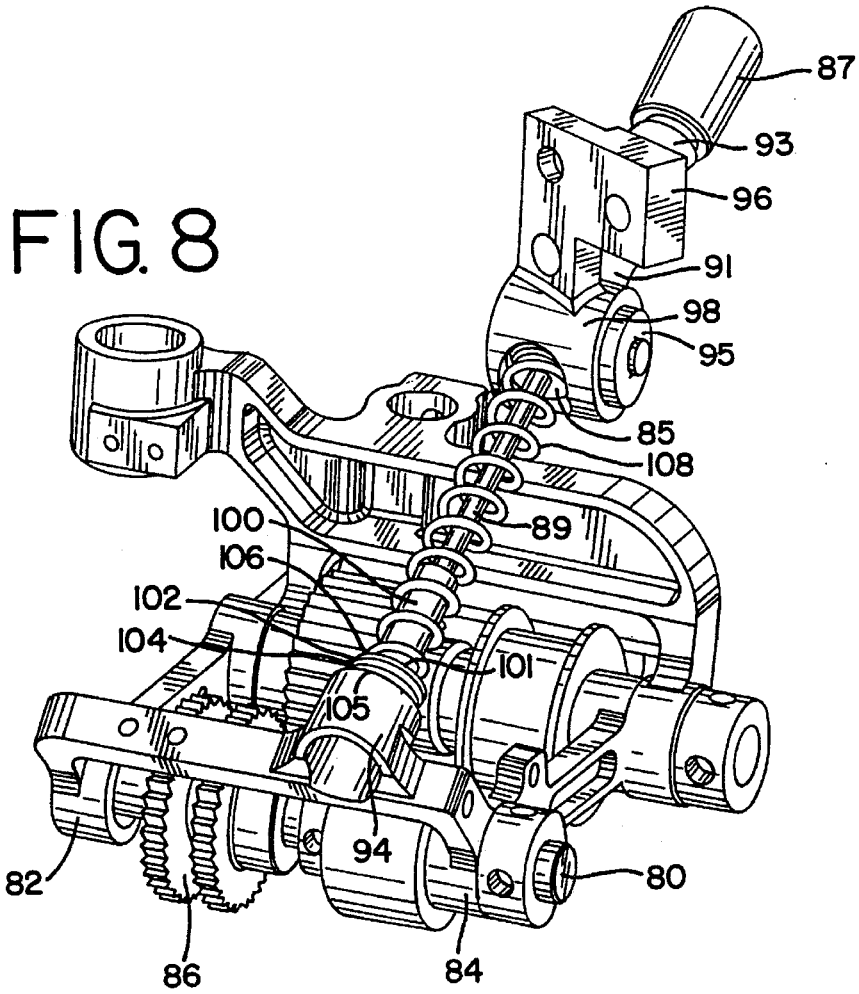
FIG. 8 is a front perspective view of a portion of the mechanism of this invention in which the manual spring for the front roller is clearly visible.

The front roller bracket 60 has an inclined U-shaped portion 92, that includes a hub 94, at its forward end. As best seen in FIGS. 2 and 8 a hub 98 having a bracket 96 that has three holes 97 formed therein is mounted by bolts (not shown) in three bolt holes (not shown) that are formed in the upper head 20. As best seen in FIG. 2 an internally threaded spring pivot bushing 95 is housed in the hub 94. An elongated compression rod 93 (see FIG. 8) having a knurled knob 87 and a threaded portion 91 is threaded through the internally threaded spring pivot bushing 95. The compression rod 93 includes a guide rod portion 89 that is of smaller diameter than the threaded portion 91. A shoulder 85 is formed on the compression rod 93 at the intersection of the threaded portion 91 and the guide rod portion 89 that functions as a thrust surface for a spring 108. A hollow guide tube 100 slidingly receives the lower end of the guide rod 89. The lower end of the hollow guide tube 100 extends into the hub 94. A thrust washer 102 with an underlaying neoprene washer 104 are received over the hollow guide tube and engage a shoulder 105 formed by the upper annular edge of the hub 94. An annular groove 101 is formed in the hollow guide tube that receives a crescent ring 106 that functions to retain the thrust washer 102 and underlaying neoprene washer 104 in place. The lower end of the spring 108 engages the thrust washer 102 to thus provide an adjustable downward pressure on the forward portion of the front roller bracket 60.

The operator can adjust the tension on spring 108 by grasping the knurled knob 87 of the compression rod 93 and turning it one way or the other. When the compression rod 93 is rotated it is threaded up or down through the internally threaded spring pivot bushing which causes the shoulder 85 of the compression rod 93 to move toward or away from the shoulder 105 of the hub 94. This causes the spring 108 to compress or expand and adjusts the downward pressure on the front roller bracket 60. The spring pivot bushing 95 can oscillate about its axis within the hub 98 which is necessary to accommodate vertical movement of the front roller 86, for example, when the front roller encounters and rides up on a cross seam. In this situation if the spring pivot bushing 95 was stationary and could not rotate about its axis the system would likely bind.

Figure 7:
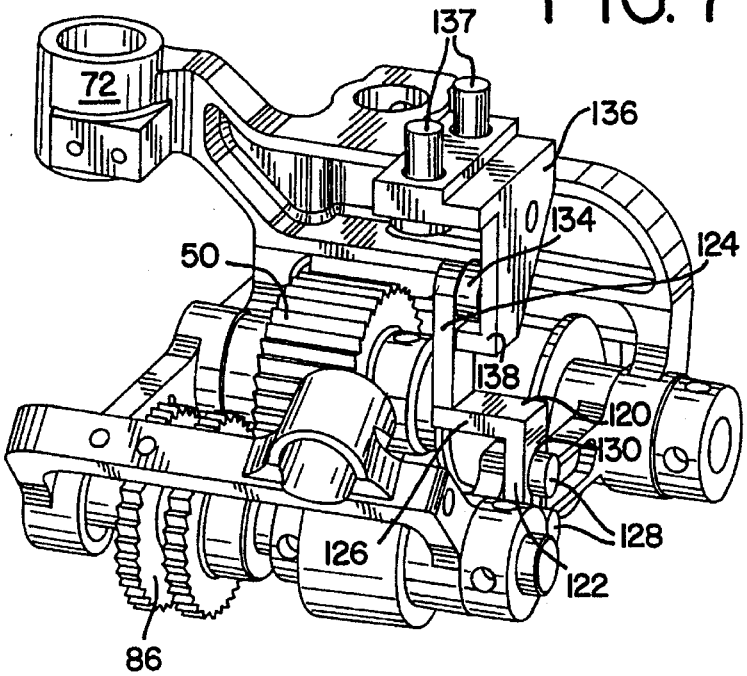
FIG. 7 is a front perspective view of a portion of the mechanism of this invention in which the height adjusting brackets are clearly visible.

There is illustrated in FIG. 7 the height adjustment mechanism for the front roller feed. A first height adjustment bracket 120 having a first vertically extending leg 122, a second vertically extending leg 124 and a connecting horizontal section 126 is secured to the front roller bracket by screws 128. A vertically extending slot 130 is formed in the first vertically extending leg 122. The screws 128 extend through slot 130 and are threaded into threaded bores 132 (see FIG. 2) formed in the front roller bracket 60. A nylon bumper 134 is secured to the upper portion of the second vertically extending leg 124. The slot 130 permits the height adjustment bracket 120 to be secured to the front roller bracket 60 within an adjustment range such that the distance between the nylon bumper 134 and the front roller bracket 60 can be varied depending upon conditions. A second height adjustment bracket 136 is secured to the upper head 20 in the general area above the location of the first height adjustment bracket 120 by screws 137. The second height adjustment bracket 136 includes a tab 138 having a horizontal upper surface that underlies the nylon bumper 134. When the nylon bumper 134 engages the horizontal upper surface of the tab 138, downward movement of the front roller bracket 60 is stopped. The position where downward movement of the front roller bracket 60 is stopped can be adjusted through the slot 130 and screws 128.

There is shown in FIG. 9 the manual lift cable assembly 140 for the front roller feed. The manual lift cable assembly 140 includes a flexible cable 142 contained in a case or shield 143 of the Bowden conduit type. The shield 143 is secured to the head 20 of the sewing machine by mounting clips 144. The upper mounting clip 144 is secured to the head 20 by one of the bolts that secure the spring pivot bracket 96 to the head 20. The lower clip 144 is secured by a screw (not shown) to the second height adjustment bracket 136. The upper end of the flexible cable 142 is connected to an arm 146 of a the lift lever bell crank 148 that is secured to and pivots with pivot rod 149. The pivot rod 149 is journaled in an opening 163 formed in the head 20. The other arm 147 of the lever 148 is connected in a conventional manner to the presser bar lift mechanism. The lower end of the flexible cable 142 is connected to the U-shaped portion 92 of the front roller bracket 60. Thus, when the presser bar lift mechanism is engaged to, for example, raise the presser bar 160, a corresponding movement is transmitted to the forward end of the front roller bracket through the flexible cable 142 and the front roller 86 to be lifted off the work product. When the presser bar 160 is lowered, the lever 148 is pivoted in the opposite direction which allows the front end of the front roller bracket 60 to descend until the nylon bumper 134 encounters the tab 138 which stops its downward movement at the preselected elevation.

Figure 5:
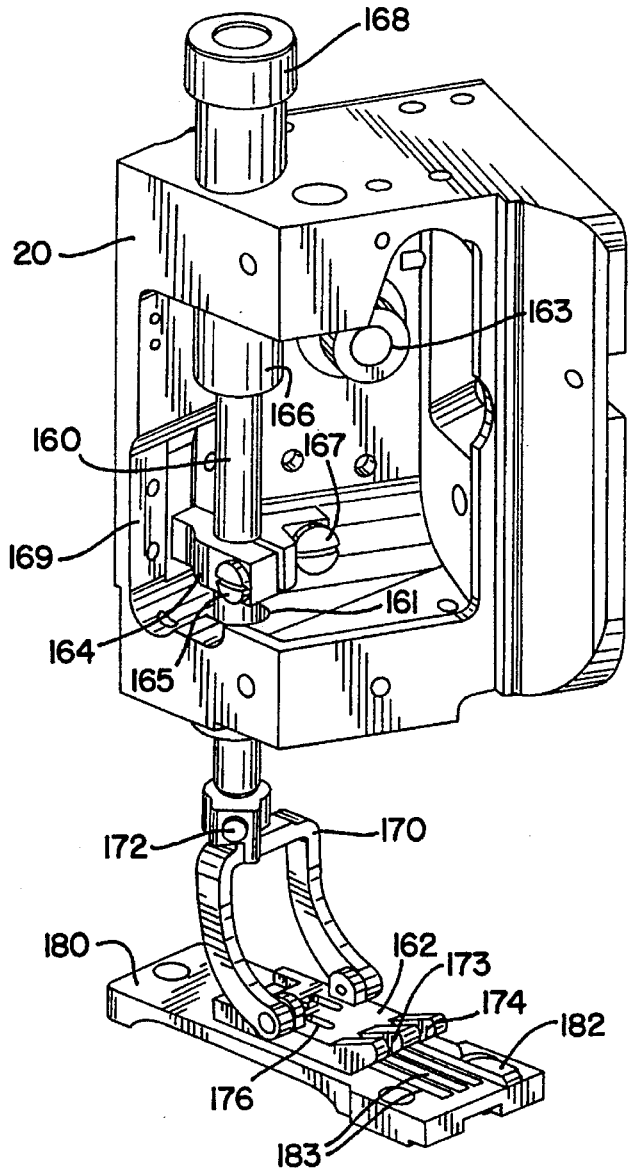
FIG. 5 is a front perspective view of a portion of the mechanism of this invention in which the presser foot bar, presser foot holder, presser foot and throat plate are clearly visible.

The presser bar 160 and presser foot 162 are illustrated in FIG. 5. The presser bar 160 is a conventional presser bar that is mounted for vertical reciprocating movement in the head 20 by bushings such as bushing 161. A presser bar lift and guide 164 is secured to the presser bar by a screw 165. A presser spring (not shown) engages the upper surface of the lift and guide 164 and a shoulder 166 to thus exert a downward pressure on the presser foot 162. A knurled knob 168 can be turned by the operator to vary the intensity of the spring pressure. Adjustable guide plates 169 are provided that cooperate with the presser bar lift and guide 169 to insure smooth reciprocal movement of the presser bar 160. As is well known in the sewing machine art, one end of a lift link (not shown) is linked to the lift and guide 164 by screw 167 and the other end of the lift link is linked to the presser bar lift lever that is carried by a pivot rod 149 that is journaled in opening 163. The lift lever bell crank 148 is secured to the other end of pivot rod 149. A presser foot holder 170 is secured to the lower end of the presser bar 160 by a set screw 172. The presser foot holder is in the form of a two tine fork that is pivotally connected to the presser foot 162 at the extremities of the tines. The presser foot 162 includes three upwardly inclined toe sections that are separated by slots 173 and 174. The presser foot 162 also has needle opening 176 formed therein. The presser foot 162 is biased downwardly toward the throat plate 180. The throat plate 180 includes a raised ridge 182 that extends in the direction of stitch formation and a plurality of slots 183 through which the feed dog elements project.

Figure 6A:
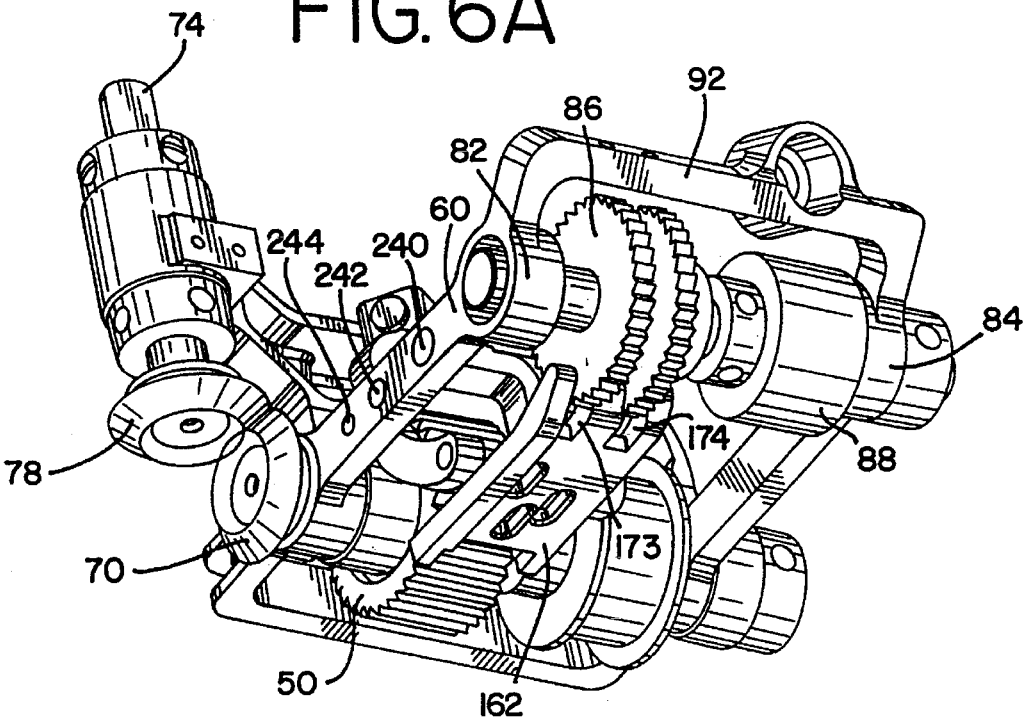
FIG. 6A is a bottom-front perspective view of a portion of the mechanism seen in FIG. 6, with the drive belt removed.
Figure 11:
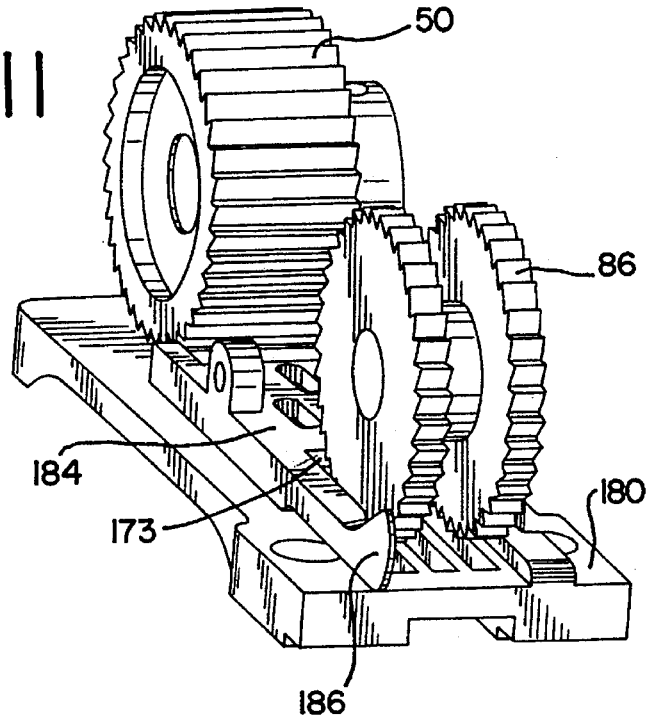
FIG. 11 is a front perspective view of a portion of the mechanism of this invention in which the throat plate, presser foot, rear roller and front roller are clearly visible.

There is shown in FIG. 11 another embodiment of a presser foot, designated 184, that includes an integral edge guide 186 that functions to guide the folded edge of the top ply of material. Edge guide 186 will ensure that the margin of material between the edge and the adjacent row of stitches remains uniform. This embodiment of the presser foot will produce a stitch with a fixed width margin of material between the folded edge of the top ply and the row of stitches. The presser foot must be replaced with a different presser foot, having the edge guide 186 at a different location relative to the needle holes, if a stitch having a margin of a different width is desired. In FIG. 11 the rear roller 50 and front roller 86 have been included to illustrated their relationship to the presser foot. It should be noted that, in the embodiment of the presser foot 162 shown in FIG. 5 as well as the embodiment of the presser foot 184 shown in FIG. 11, the two sections of front roller 86 are located within the slots 173 and 174 formed in the presser foot and one of the presser foot toes is located between the sections of the front roller 86. This relationship is best illustrated in FIG. 6A which is a bottom view of the presser foot 162. This is an important relationship of this invention since the top ply of material has a tendency to stick to the front roller 86 and ride up with it. The presence of the presser foot toe between the sections of the front roller 86 functions to strip the top ply of the work product off the front roller and cause it to feed under the presser foot as desired. FIG. 6A also illustrates that the rear roller 50 is in a position relative to the presser foot 162 to exercise control over the work product as soon as control is lost by the presser foot.

Figure 12:
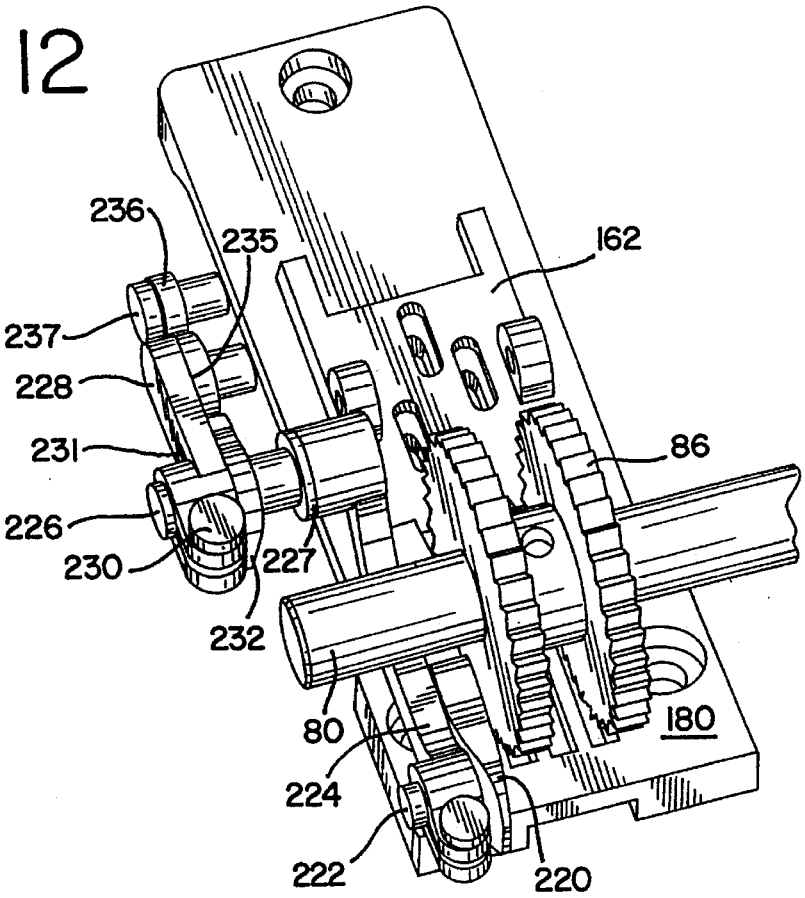
FIG. 12 is a top perspective view of a portion of the mechanism of this invention including the adjustable edge guide embodiment.
Figure 13:
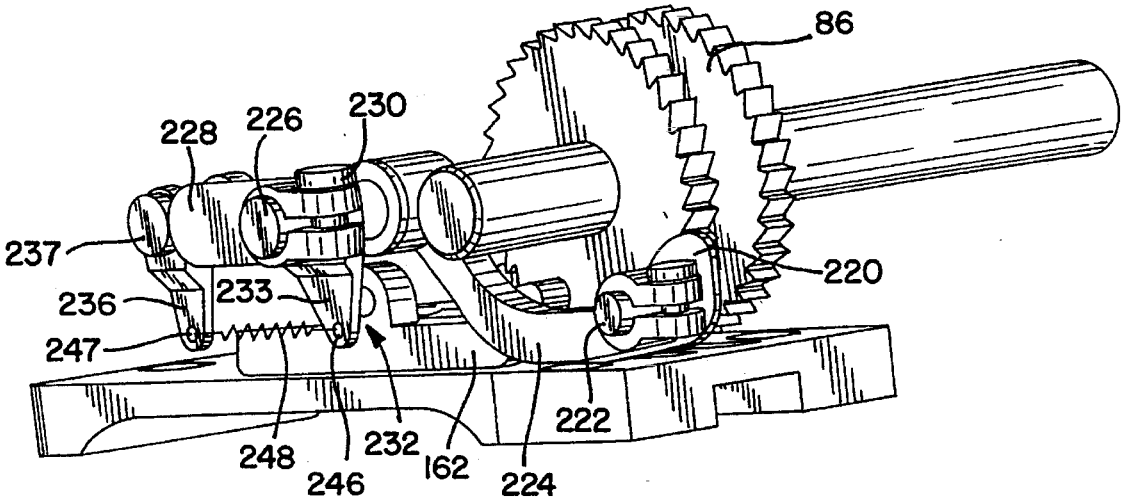
FIG. 13 is a front perspective view of a portion of the mechanism of this invention including the adjustable edge guide embodiment.
Figure 14:
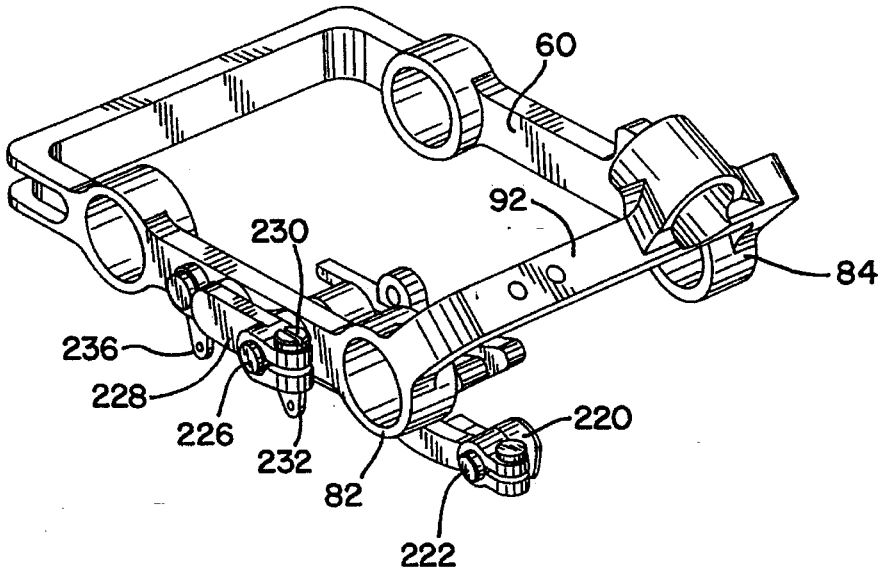
FIG. 14 is a front perspective view of a portion of the mechanism of this invention including the front roller bracket and the adjustable edge guide embodiment.

FIGS. 12, 13 and 14 disclose an embodiment in which the edge guide 220 for the top ply of work product is adjustable laterally so that the margin of material between the folded edge and the row of stitches can be varied without the need to replace the presser foot. The adjustable edge guide 220 is adjustable left to right relative to the line of stitching to vary the width of the margin between the folded edge of the upper ply of material and the row of stitches. The mounting mechanism that carries the adjustable edge guide 220 is mounted in holes 240, 242 and 244 (see FIG. 6A) formed in the front roller bracket 60. Through its mounting mechanism the adjustable edge guide 220 is independently spring loaded so that it can contact the work material and rise up and down as it crosses over seams.

The edge guide 220 has an integral edge guide mounting pin 222 that extends into an opening 223, formed in the guide arm 224. The edge guide mounting pin 222 can slide longitudinally of its axis in opening 223 and can be locked in a longitudinal adjusted position by a screw 225. This longitudinal adjustment and locking in a selected location allows the edge guide 220 to be adjusted left or right of the row of stitches and thus to establish the width of the margin. This adjustable feature allows the margin to be varied without replacing the presser foot 162. The guide arm 224 has a pivot shaft 226 at its rear end that extends through hole 240 that is formed in the front roller bracket 60 (see FIG. 6A). A washer 227 is carried by pivot shaft 226 for engagement with the surface of the front roller bracket 60 to provide free pivot movement. The pivot shaft 226 allows the edge guide 220 to pivot up and down as is required for it to cross over seams and the like. A front spring finger 232 is carried by the portion of the pivot shaft 226 that projects out of hole 240 on a aperture (not shown) formed in the front spring finger 232. The front spring finger 232 includes a downwardly directed arm 233 and a check pin 231 that extends parallel to pivot shaft 226. A hole 246 is formed at the lower extremity of the downwardly directed arm 233 for receiving one end of a spring 248. An edge guide thruster 228 is carried by the pivot shaft outwardly of the front spring finger 232. The edge guide thruster 228 includes an arm 229 that has an aperture formed therein for reception of the check pin 231 of the front spring finger 232. The edge guide thruster 228 is secured to the pivot shaft 226 by a screw 230. Thus, the downwardly directed arm 233 of the front spring finger 232 and the arm 229 of the edge guide thruster 228 are fixed to the pivot shaft 226 and pivot therewith. A thrust pin 234 made, for example, of nylon material, having a flat head 235 is carried by hole 242 formed in the front roller bracket 60. The arm 229 of the edge guide thruster 228 is flush with and slides along the flat head 235 of the thrust pin 234. A rear spring finger 236 is secured in the threaded hole 244 formed in the front roller bracket 60 by a screw 237. An opening 247 is formed at the extremity of the rear spring finger 236 for the reception of the other end of spring 248. Spring 248 extends from the rear spring finger 236 to the front spring finger 232 and functions to exert a clockwise torque on pivot shaft 226 and thus, a downward spring pressure on the edge guide 220. The magnitude of this downward spring pressure can be adjusted by adjusting the location of rear spring finger 236 by loosening screw 237 adjusting the location of the rear spring finger 236 and securing it in adjusted position by the screw 237.

FIG. 15 discloses the preferred embodiment for controlling the rear shaft 32. In this embodiment a double acting air cylinder 200 is connected to the upper end of shaft 32 above the top plate 22. Pressurized air can be supplied to either side of the piston of air cylinder 200. When air under pressure is supplied to cylinder 200 causing a downward pressure to be applied to the main bracket 34, a spring that performs that task in the manual embodiment is eliminated. When air under pressure is supplied to cylinder 200 causing the main bracket to be lifted up off the work product, the manual lift handle 40 has been eliminated. The sewing machine operator can control the pressurized air that is directed to double acting air cylinder 200.

FIG. 16 discloses the preferred embodiment for raising and lowering the presser bar 160. A double acting air cylinder 202 is connected to the top of the presser bar 160 above the top plate 22. Air cylinder 202 is energized in one direction to raise the presser bar 160 and in the other direction to lower it. The sewing machine operator can control the pressurized air that is directed to double acting air cylinder 202.

FIG. 17 discloses the preferred embodiment for raising the front end of the front roller bracket 60 and the front roller 86. In this embodiment a double acting air cylinder 204 is connected to front air shaft 206. As in the mechanical embodiment that is illustrated in FIG. 8 a pivot bushing 208 is journaled for oscillating motion in the hub 98. The front air shaft 206 extends through a bore formed in the pivot bushing 208 into front air adapter 210. Within the front air adapter 210, the front air shaft 206 is coupled to the piston rod (not shown) of the double acting air cylinder 204. A clamp 212, thrust washer 214 and a neoprene washer 216 are provided at the lower end of the front air shaft 206 to transfer the reciprocating motion of the front air shaft 206 to the U-shaped portion 92 of the front roller bracket 60. In the mechanical embodiment, (see FIG. 8) the front roller spring 108 functions to provide an adjustable pressure in the downward direction on the front roller bracket 60. This function is replaced in the preferred air cylinder embodiment by air cylinder 204. However, in the preferred air cylinder embodiment, the air cylinder 204 also performs the function of raising and lowering the front end of the front roller bracket 60. That function in the mechanical embodiment is performed by the manual lift cable assembly 140 that is illustrated in FIG. 9. The sewing machine operator can control the pressurized air that is directed to double acting air cylinder 204.

While the invention has heretofore been described in detail with particular reference to the illustrated apparatus, it is to be understood that variations, modifications and the use of equivalent mechanisms can be affected without departing from the scope of this invention. It is, therefore, intended that such changes and modifications be covered by the following claims.

What is claimed is:

1. A sewing machine including a sewing head and a lower arm;

a throat plate carried by said lower arm, said throat plate having a flat upper surface including a portion that has no apertures formed therethrough;

stitch forming mechanism including reciprocating needles mounted on said sewing head; a presser foot carried by said sewing head; a main bracket mounted on said sewing head such that it can be moved toward and away from said throat plate; a rear roller shaft journaled on said main bracket; a rear feeder roller secured to said rear roller shaft and disposed above said portion of the throat plate that has no apertures formed therethrough and to the rear of said presser foot;

a material folding device mounted on said lower arm forward of said throat plate, at a location relative to said stitch forming mechanism to provide desired margins between the folded edges and the stitch line, for folding material to be fed to said stitch forming mechanism;

a front roller bracket connected to said sewing head; a front roller shaft journaled on said front roller bracket, a front feeder roller carried by said front roller bracket, said front feeder roller functioning to receive the folded material from the folding device, positively feed the folded material into the stitch forming mechanism such that the control of the margins is improved and the need for manually controlling the folded material is diminished; and driving mechanisms for positively driving said rear and front feeder rollers.

2. A sewing machine for producing the rows of stitches for a felled seam in folded material received from a folding device that is located to provide desired margins between the folded edges and the stitch line, including a sewing head and a lower arm;

a throat plate carried by said lower arm;

stitch forming mechanism including needles mounted on said sewing head; a presser foot carried by said sewing head; a main bracket mounted on said sewing head such that it can be moved toward and away from said throat plate; a rear roller shaft journaled on said main bracket; a rear feeder roller secured to said rear roller shaft and disposed above said throat plate and to the rear of said presser foot;

a front roller bracket pivotally connected to said main bracket; a front roller shaft journaled on said front roller bracket, a front feeder roller carried by said front roller bracket, said front feed roller functioning to receive the folded material from the folding device, positively feed the folded material into the stitch forming mechanism such that the control of the margins is improved and the need for manually controlling the folded material is diminished; and driving mechanisms for said rear and front feeder rollers.

3. The invention as set forth in claim 2 wherein said rear roller shaft is drivingly connected to said front roller shaft and the latter is driven by the former such that the front feeder roller is driven in synchronism with the rear feeder roller.

4. The invention as set forth in claim 2 wherein independent biasing mechanisms are provided for biasing said main bracket and said front roller bracket toward said sewing head.

5. The invention as set forth in claim 4 wherein mechanisms are provided for raising and holding the main bracket and said front roller bracket to and at a position spaced above said lower arm.

6. The invention as set forth in claim 4 wherein said independent biasing mechanisms for biasing said main bracket and said front roller bracket toward said sewing head are air cylinders.

7. The invention as set forth in claim 5 wherein said mechanisms for raising and holding the main bracket and said front roller bracket to and at a position spaced above said lower arm are air cylinders.

8. The invention as set forth in claim 2 wherein said presser foot includes an integral forwardly extending edge guide that functions to engage the folded edge of the upper ply of material and establish a consistent margin between the folded edge of the upper ply of material and the line of stitches.

9. The invention as set forth in claim 2 wherein an adjustable edge guide member is mounted through mounting mechanism to said front roller bracket such that said adjustable edge guide member can be adjusted right and left of the row of stitches.

10. The invention as set forth in claim 2 wherein an adjustable edge guide member is mounted through mounting mechanism to said front roller bracket such that said adjustable edge guide member can ride up and down relative to the front roller bracket.

11. The invention as set forth in claim 9 wherein an adjustable edge guide member is mounted through mounting mechanism to said front roller bracket such that said adjustable edge guide member can ride up and down relative to the front roller bracket.

12. The invention as set forth in claim 2 wherein said presser foot includes at least three forwardly extending toes with slots therebetween and wherein said front feed roller includes multiple relatively thin sections that are sized and located such that they extend into said slots formed between the toes of said presser foot such that material that rides up with said front feed roller is stripped off by said toes.

13. A sewing machine for producing the rows of stitches for a felled seam including a sewing head and a work supporting surface;

stitch forming mechanism for forming a stitch in a stitch forming area, said stitch forming mechanism including needles mounted in said sewing head, a throat plate carried by said work supporting surface and a presser foot carried by said sewing head;

a main roller puller bracket mounted for reciprocal motion on said sewing head, a rear roller puller rotatably mounted on said main roller puller bracket about a generally horizontal axis, at a location rearward of said stitch forming area, a front roller bracket pivotally mounted on said main roller puller bracket about said generally horizontal axis, said front roller bracket having a forward portion, a front roller rotatably mounted on the forward portion of said front roller bracket at a location forward of said stitch forming area, drive mechanism for said rear and front rollers operable to drive them in a direction to advance the work product along a line of feed from front to rear;

said presser foot being located between said front roller and said rear roller puller; and lifting mechanisms for raising and lowering said main roller puller bracket and the forward portion of said front roller bracket toward and away from said work supporting surface.

14. The invention as set forth in claim 13 wherein said drive mechanism includes a drive between said rear roller puller and said front roller puller and the later is driven by the former such that the front roller is driven in synchronism with the rear roller puller.

15. The invention as set forth in claim 13 wherein independent biasing mechanisms are provided for biasing said main bracket and said front roller bracket toward said sewing head.

16. The invention as set forth in claim 15 wherein mechanisms are provided for raising and holding the main bracket and said front roller bracket to and at a position spaced above said work supporting surface.

17. The invention as set forth in claim 15 wherein said independent biasing mechanisms for biasing said main bracket and said front roller bracket toward said sewing head are air cylinders.

18. The invention as set forth in claim 16 wherein said mechanisms for raising and holding the main bracket and said front roller bracket to and at a position spaced above said lower arm are air cylinders.

19. The invention as set forth in claim 13 wherein said presser foot includes an integral forwardly extending edge guide that functions to engage the folded edge of the upper ply of material and establish a consistent margin between the folded edge of the upper ply of material and the line of stitches.

20. The invention as set forth in claim 13 wherein an adjustable edge guide member is mounted through mounting mechanism carried by said front roller bracket such that said adjustable edge guide member can be adjusted right and left of the rows of stitches.

21. The invention as set forth in claim 13 wherein an adjustable edge guide member is mounted through mounting mechanism carried by said front roller bracket such that said adjustable edge guide member can ride up and down relative to said front roller bracket.

22. The invention as set forth in claim 20 wherein an adjustable edge guide member is mounted through mounting mechanism carried by said front roller bracket such that said adjustable edge guide member can ride up and down relative to said front roller bracket.

23. The invention as set forth in claim 13 wherein said presser foot includes at least three forwardly extending toes with slots therebetween and wherein said front roller includes multiple relatively thin sections that are sized and located such that they extend into said slots formed between the toes of said presser foot such that material that rides up with said front feed roller is stripped off by said toes.

24. The method of producing rows of stitches at the stitch forming area of a folded work product that has been folded to produce a felled seam comprising the steps of:

(a) biasing a rear feed roller downwardly into contact with the upper surface of the work material rearward of the stitch forming area;

(b) biasing a front feed roller downwardly into contact with the upper surface of the work material forward of the stitch forming area;

(c) providing positive, continuous, uninterrupted drive directly to the rear and front feed rollers in a direction that will cause said front and rear feed rollers, respectfully, to pull and push the work material from and to the stitch forming area; and (d) guiding the edge of the folded work product such that the edge is maintained at a constant space from the rows of stitches and a consistent marginal edge is produced.

25. The method as set forth in claim 24 including the additional step of:

(e) driving the front feed roller from the rear feed roller in order to synchronize the magnitude of the pull and push that is being exerted on the work material.

26. The method as set forth in claim 24 including the additional step of:

(f) adjusting the biasing force on the front feed roller independently of the biasing force being applied to the rear feed roller; and (g) adjusting the biasing force on the rear feed roller independently of the biasing force being applied to the front feed roller.

27. The method as set forth in claim 24 including the additional step of:

(h) utilizing air cylinders to apply the biasing force to the rear and front feed rollers.

28. The method as set forth in claim 24 including the additional step of:

(i) adjusting the mechanism used for guiding the edge of the work product to produce a finished product with a margin of a preferred size.

29. The method as set forth in claim 24 including the additional step of:

(j) mounting the mechanism used to guide the edge of the work product such that it can move vertically relative to the front feed roller.

30. The method as set forth in claim 24 including the additional step of:

(k) stripping off the work product that is riding up the discharge side of the front feed roller to insure that the work product will pass under the presser foot.

* * * * *